US005547416A

United States Patent [19]

Timms

[11] Patent Number: 5,547,416

[45] Date of Patent: Aug. 20, 1996

[54] SKATE SHARPENING GAUGE

[76] Inventor: Alfred R. Timms, 4650 Martingale Crescent, Langley, British Columbia, V3A 4P6, Canada

[21] Appl. No.: 295,080

[22] Filed: Aug. 26, 1994

[51] Int. Cl.[6] ..... B24B 7/19

[52] U.S. Cl. ..... 451/45; 451/234; 451/193; 451/383

[58] Field of Search ..... 451/234, 241, 451/45, 193, 229, 383, 545, 555, 556, 224

[56] References Cited

U.S. PATENT DOCUMENTS

| | | | |
|---|---|---|---|
| 3,881,280 | 5/1975 | Thompson | 51/102 |
| 3,988,124 | 10/1976 | Babcock | 51/96 |
| 4,094,101 | 6/1978 | Robinson | 51/5 |
| 4,109,419 | 8/1978 | Broadbent | 51/94 |
| 5,345,688 | 9/1994 | Allen | 33/535 |
| 5,379,633 | 1/1995 | Filsram et al. | 73/104 |

*Primary Examiner*—Bruce M. Kisliuk
*Assistant Examiner*—Eileen P. Morgan
*Attorney, Agent, or Firm*—Myers, Liniak & Berenato

[57] ABSTRACT

A device for accurately locating the blade of a skate mounted in a skate holder so that it may be ground correctly. The device includes a base block mounted to a base of a skate sharpener, a lever pivotally mounted to the block, the block having a blade contacting surface which is substantially perpendicular to the sharpener base, a deflection gauge for measuring the deflection of the lever from a neutral position. A pivotal axis of the lever is parallel to a plane through grinder wheel and parallel to the sharpener base.

11 Claims, 3 Drawing Sheets

SKATE SHARPENING GAUGE

BACKGROUND

The present invention relates to a device used to measure the accuracy of the sharpening of an ice skate blade.

FIELD

In sharpening the blades of a set of ice skates the object is to sharpen the edge so that it is concave when viewed in cross-section with both side edges being parallel and equidistant from the level of the trough of the concave ground edge of the skate blade. Both side edges should touch the ice with the skater in the standing position. If the side edges are not equidistant from the level of the trough of the blade, a skater will not be able to hold an inside or outside side edge or transfer properly from one side edge to the other.

Thus, in order to properly sharpen a skate blade, it is necessary to have the blade positioned parallel to a plane that bisects the grinding wheel. If the blade is high relative to the grinding wheel, then the side edge nearest the top of the wheel will be further out than the side edge nearest the bottom. Conversely, if the blade is low relative to the grinding wheel, then the side edge nearest the bottom surface of the wheel will be further out than the side edge nearest the top surface of the wheel. Currently, a coin is balanced on the inverted bottom surface of the skate blade and the blade's squareness visually estimated. The accuracy of this method is dependent on the skill of the individual sharpening the skates. Obviously, the accuracy will often vary from one set of skates to the next. The experienced skater will be able to tell if the blade is accurately sharpened through use. Should the blade not be accurately sharpened the solution is to re sharpen the blade and, thus, lower its life expectancy.

Accordingly, it is an object of the invention to provide a device for measuring the accuracy of sharpening an ice skate blade.

SUMMARY OF THE INVENTION

According to the invention there is provided a device for measuring the sharpening accuracy of an ice skate blade which includes a base block, a lever pivotally journaled to said base and gauge means for measuring the deflection of the lever block from a neutral position in which the blade contacting surface is vertically oriented. The pivotal axis of the lever is parallel to a plane of the grinder wheel and parallel to the base of the sharpener.

The gauge means may be a dial gauge having a piston abutting a surface of the lever block.

In another aspect of the invention there is provided a method of measuring the accuracy of sharpening a skate blade which includes positioning a lever block which is pivotal about a horizontal axis such that when in a neutral position the lever block has a vertically disposed blade contact surface and so that the pivotal axis of the lever block is centered with respect to that grinding wheel surface, and mounting the skate blade proximate the lever block such that the skate is parallel to and at the same level as the pivotal axis of the lever block. The method includes sharpening the blade, positioning the skate blade against the blade contact surface of the lever block and measuring the deflection of the blade contacting surface from vertical. Should the deflection be non-zero, the level of the blade is adjusted and the procedure repeated until the displacement is zero.

The method and apparatus of the present invention results in accurate skate sharpening on a consistent basis. The invention provides a simple procedure for skate sharpening the accuracy of which no longer depends on the skill of the operator.

BRIEF DESCRIPTION OF THE DRAWINGS

The invention may be best understood by reference to the detailed description which follows, in conjunction with the accompanying drawings, wherein.

DETAILED DESCRIPTION WITH REFERENCE TO THE DRAWINGS

Figure 1:
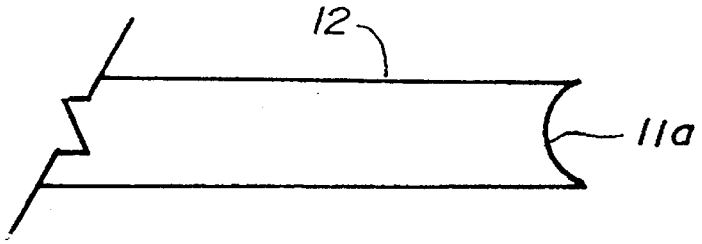
FIG. 1 is a cross-sectional view of a skate blade which has been sharpened correctly.
Figure 2:
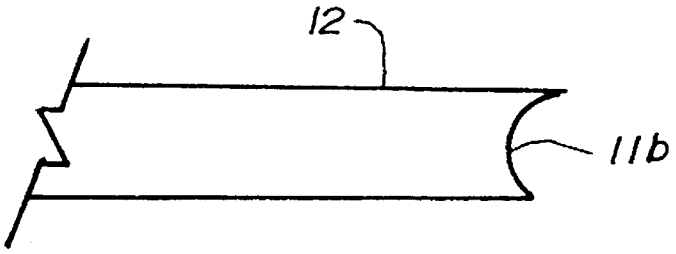
FIG. 2 is a cross-sectional view of a skate blade which has been set too high prior to sharpening.
Figure 3:
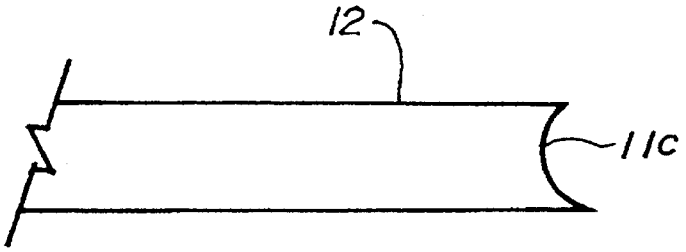
FIG. 3 is a cross-sectional view of a skate blade that has been set too low relative to the grinding wheel prior to sharpening.
Figure 6:
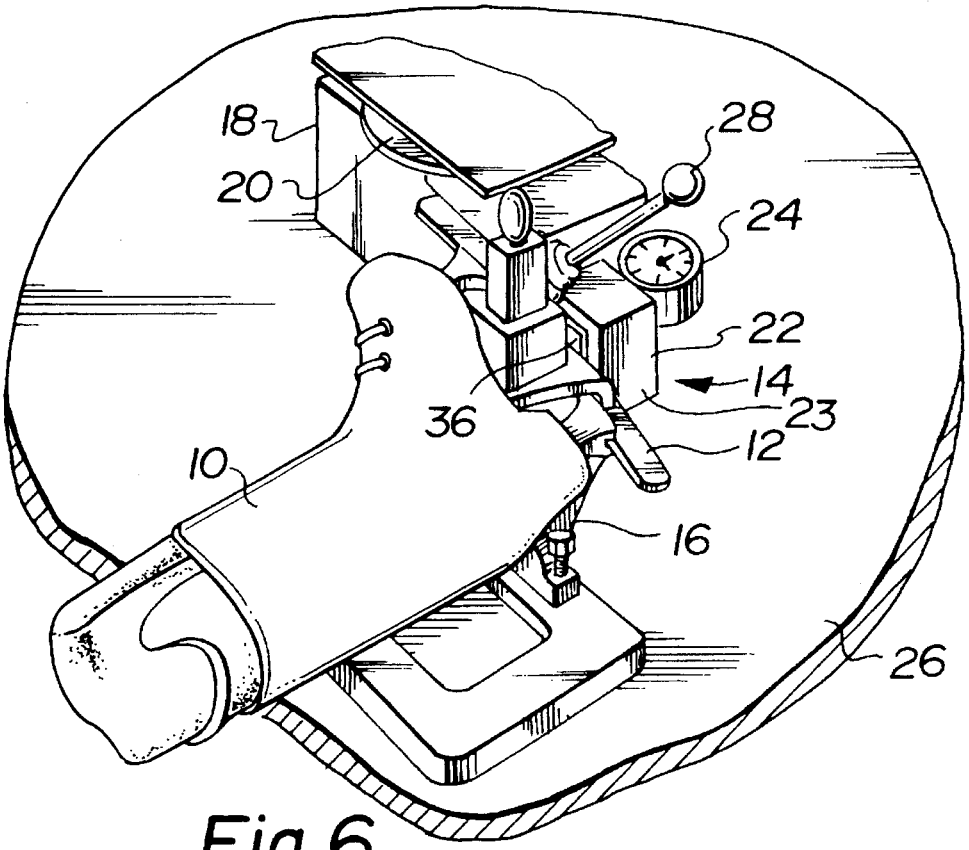
FIG. 6 is a perspective view of a skate positioned with its blade abutting the skate blade position measuring device prior to sharpening.
Figure 7:
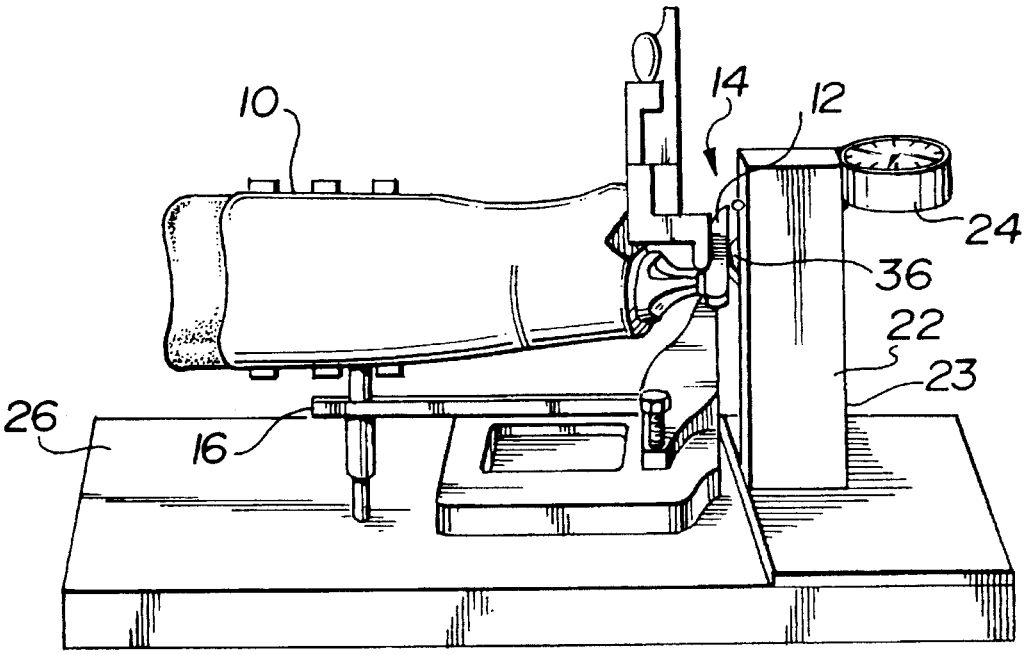
FIG. 7 is perspective view similar to that of FIG. 6 except showing a rear of the boot.

Referring to FIG. 1 there is shown a position of a skate blade in cross-section with the ice contacting surface of the blade 11*a* having a concave shape with the side edges at the same distance from a notional line through the bottom of the trough perpendicular to the sides 12. Such a shape corresponds to that of an accurately ground skate. FIG. 2 shows a ground surface 11*b* resulting from the blade being too high relative to the grinding wheel 20 (see FIG. 6), while FIG. 3 shows the shape when the blade is too low relative to the grinding wheel. In both of the latter two Figures it will be seen that when the blade is not centered with respect to the plane bisecting the grinding wheel the edges of the blade at the ice contacting surface are not equidistant from the bottom of the ground trough 11*b* and 11*c*. With such a profile the skater will not be able to grip the ice with the edge needed to turn, spin, accelerate or stop.

Figure 4:
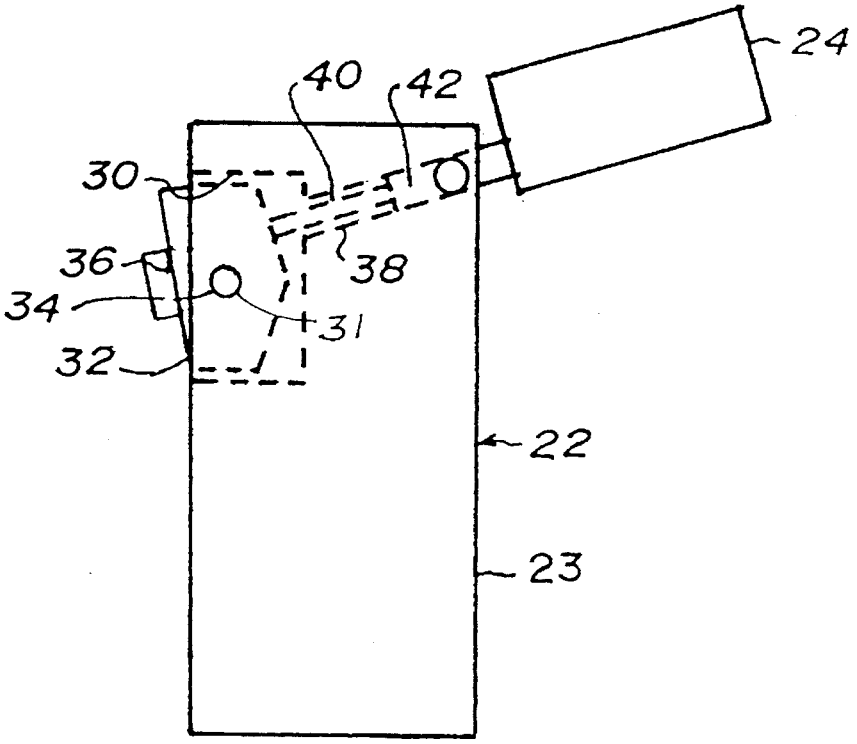
FIG. 4 is a side elevation view of the skate blade position measuring device.
Figure 5:
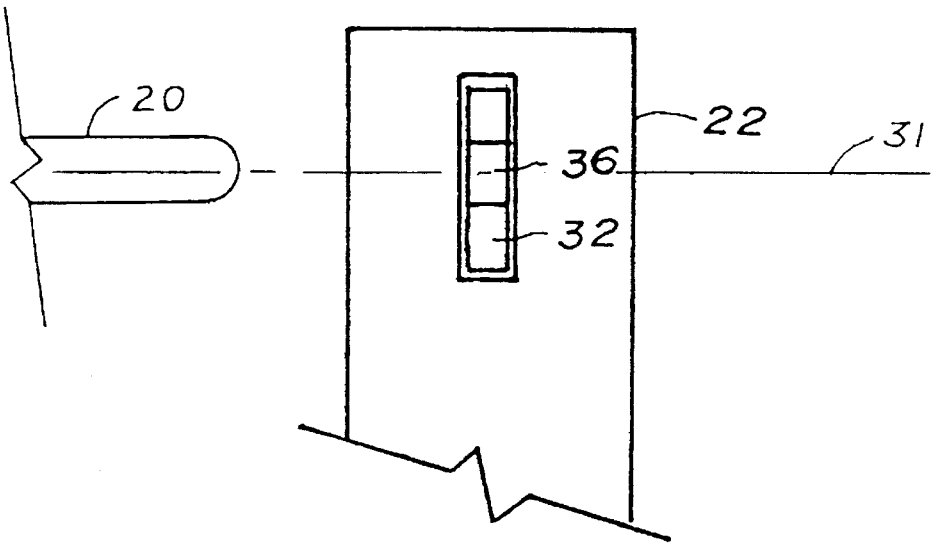
FIG. 5 is a front elevation view of the skate blade measuring device.

Referring to FIGS. 4 and 5 there is shown a skate sharpener blade position measuring device 22 consisting of a base block 23 having an elongated rectangular opening 30. A lever block 32 is pivotally mounted on pins 34 to base block 23 within opening 30 and pivots about pivotal axis 31. On an outside face of lever block 32 there is mounted a carbide block 36 at the same level as pin mounting 34. A dial gauge 24 having sleeve 42 extending into the rear of base block 23 through a cylindrical passage 38 has a piston 40 which abuts a back surface of lever block 32 and slid through sleeve 42. As lever block 32 pivots it either causes piston 40 to extend or retract resulting in a change of the reading on dial gauge 24.

In operation a skate boot 10 is mounted on a conventional skate holder 16 of a skate sharpening apparatus 14 with its blade 12 parallel to a skate holder table 26. The blade 12 is positioned against the carbide piece 36 and raised or lowered until it is estimated to be at the center of the pivotal axis which is at the same elevation from the table 26 as the center of the grinding wheel 20 of the lever block 32. With grinding wheel 20 rotating in response to operation of grinding wheel motor 18, the skate holder 16 is then slid over table 26 towards the grinding wheel 20 over table 26 so that the blade 12 is sharpened. Once sharpening in a connectional manner has been completed the skate blade 12 is juxtaposed to lever block 32 against carbide block 36. The two edge of the blade will contact carbide block 36 and determine the orientation of lever block 32. If the dial gauge 24 has a zero reading then the blade sharpening has been accurate. If not, then the blade must be raised if the dial gauge indicates a lower side edge projects out further than an upper side edge and lowered if an opposite reading is obtained.

Once the grinding of the blade 12 is completed the edges will be equidistant from a notional line through the trough in the ground surface and perpendicular to the sides of the blade 12.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. For use in a skate blade sharpening apparatus having a grinding wheel mounted on a table and a skate holder slidably mounted on said table and operative to clamp a skate so that said skate blade can be slid into and out of contact with the grinding wheel and thereby sharpen said blade, a device for determining whether or not a skate blade has been accurately sharpened, comprising:

(a) a base block affixable to said table;

(b) a pivotal block pivotally journaled to said base block about a pivotal axis, having an outer skate contacting surface disposed at a level of said pivotal axis when said base block is affixed to said table; and (c) measuring means coupled to said pivotal block for measuring the pivotal displacement of said outer skate contacting surface of said pivotal block from a vertical orientation in response to contact by the blade of an ice skate mounted in said skate holder.

2. A device according to claim 1, wherein said skate contacting surface is vertically disposed when in its rest position and said base block is affixed to said frame.

3. A device according to claim 2, wherein measuring means is a dial gauge having a piston in abutting contact with said pivotal block at a point remote from said pivotal axis so as to sense pivotal movement thereof from a neutral position in which the skate blade contacting surface is vertical when said pivotal block is affixed to said frame and said frame is in an operative position.

4. A device according to claim 2, wherein said base block has a slot dimensioned to receive said pivotal block and to permit pivotal movement thereof and the skate contacting surface of said pivotal block has a carbide material on said skate contacting surface.

5. A skate blade sharpening apparatus of a type having a table, a grinding wheel mounted on the table and a skate holder for holding a skate with said skate blade in position to be sharpened by sliding movement of the holder past the grinding wheel, comprising:

(a) a base block mounted to the table of the skate blade sharpener apparatus;

(b) lever means pivotally mounted to said block and pivotal about a pivotal axis, said lever means having a blade contacting surface which is substantially perpendicular to said sharpener table; and (c) gauge means for measuring deflection of said lever means from a neutral position in which the blade contacting surface is perpendicular to said table;

wherein a pivotal axis of said lever means is parallel to a plane through a center of said grinder wheel and parallel to said sharpener table.

6. Apparatus according to claim 5, wherein said base block has an elongated slot and said lever means is a block pivotally mounted in said slot.

7. Apparatus according to claim 5, wherein said means for measuring is a dial gauge having a piston extending through said base block into said slot and abutting against a surface of said lever block.

8. Apparatus according to claim 6, including a hardened material affixed to said blade contacting surface at a position of contact with a skate blade being sharpened.

9. Apparatus according to claim 8, wherein said hardened material is carbide.

10. A method of measuring the accuracy of skate blade sharpening, comprising:

(a) locating a pivotal block, pivotal about an axis parallel to a skate blade sharpening table, having a skate blade contacting surface substantially perpendicular to said table when said pivotal block is in a neutral position, and said axis is at a level of a center of a skate blade grinding wheel grinding surface;

(b) adjusting a skate position in said skate blade holder until the blade is at the level of the horizontal pivotal axis;

(c) moving the skate holder so that the skate blade slides over the grinding surface of the grinding wheel and sharpens the blade;

(d) moving the skate blade so that it abuts said skate blade contacting surface of the pivotal block and aligns said skate blade contacting surface of said block to outside edges of said skate blade;

(e) measuring the displacement of said skate blade contacting surface of said pivotal block from vertical alignment; and (f) if the displacement from vertical alignment is non-zero, adjusting the level of said blade and repeating steps (b) to (e) until the displacement is zero.

11. A method according to claim 10, wherein said measuring step includes placing a dial gauge sensing piston against said pivotal block at a position remote from the pivotal axis and on a side opposite said skate contacting surface.

* * * * *